United States Patent [19]

Aspenson et al.

[11] 4,124,055

[45] Nov. 7, 1978

[54] CANOPY DOOR

[75] Inventors: Gary Lee Aspenson, Cresco; James Holger Andersen, Janesville, both of Iowa

[73] Assignee: Mosher Doors, Inc., Riceville, Iowa

[21] Appl. No.: 799,969

[22] Filed: May 24, 1977

[51] Int. Cl.[2] ..... E05F 15/00

[52] U.S. Cl. ..... 160/193; 160/213

[58] Field of Search ..... 160/188, 193, 207, 213; 49/197-200

[56] References Cited

U.S. PATENT DOCUMENTS

| | | | |
|---|---|---|---|
| 2,393,052 | 1/1946 | Mehard | 160/213 |
| 2,936,830 | 5/1960 | Mosher | 49/199 |
| 3,024,838 | 3/1962 | Egleston et al. | 160/193 |

*Primary Examiner*—Peter M. Caun

*Attorney, Agent, or Firm*—Henderson, Strom, Sturm, Cepican & Fix

[57] ABSTRACT

A canopy door including a pivotally mounted leaf adapted to swing on a fixed horizontal axis between an open and a closed position, and an extensible strut having an intermediate pivot point disposed in an over-center position when the door is closed. Operating cables, driven by a common shaft, are attached to the leaf and strut; and are payed out and taken up to move the door between its open and closed positions. One of the operating cables exerts an upward force on the strut to move it from its over-center position, thereby exerting an initial outward opening force on the door.

3 Claims, 11 Drawing Figures

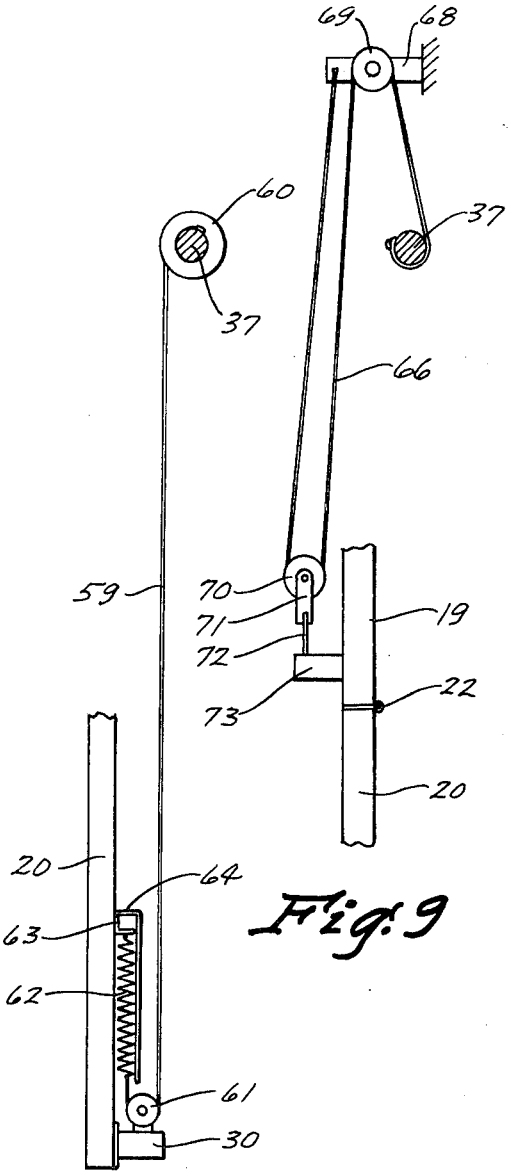
Fig. 9
Fig. 8
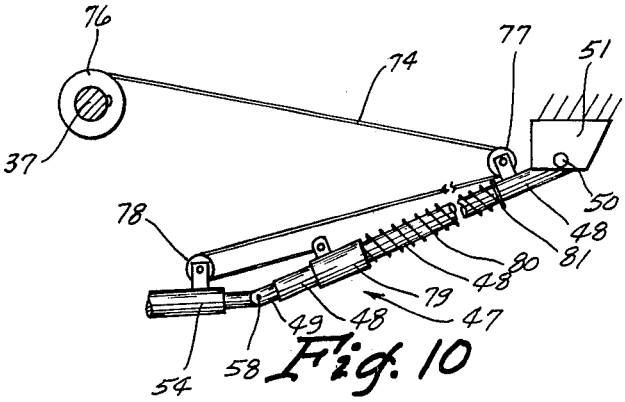
Fig. 10
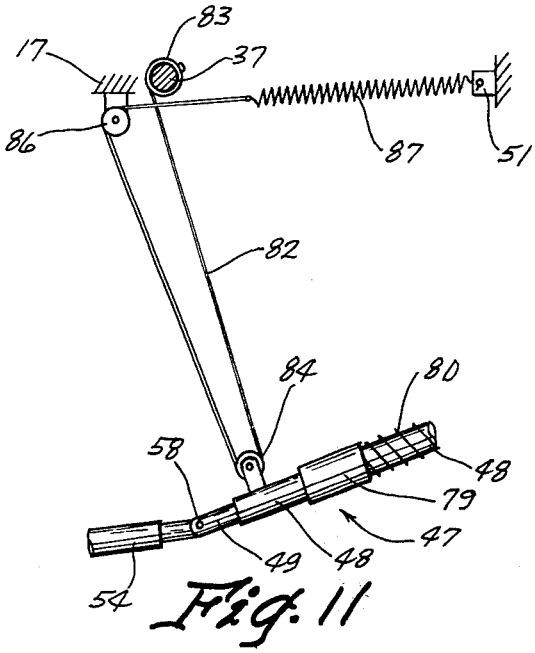
Fig. 11

CANOPY DOOR

BACKGROUND OF THE INVENTION

The present invention relates generally to canopy type doors and more particularly to canopy doors of a single or double leaf construction suitable for use in buildings having large openings, such as airplane hangers, wardhouse docks, or garages.

Due to the large surface area of large canopy doors, one of the problems associated with their use has been to adequately stabilize the door against wind gusts, particularly when the door is in the fully closed position. Extensible diagonal bracing struts have been used to stabilize bifold doors in the area near the joint of the two leaves; and various stops have been used to stabilize the lowermost portion of the lower leaf.

One of the most critical problems associated with large canopy doors has been the difficulty of achieving the initial opening of the door. The opening cables are spaced close to the plane of the door when the door is in the closed position to yield a simple, uncluttered design. The close spacing of the cables to the door leaves, however, results in a relatively short moment arm which makes it difficult to initially break the door to swing it upward on its horizontal axis.

The prior art shows bracing struts used to provide an initial outward force. Specifically, U.S. Pat. No. 2,936,830 shows a strut having a cable attached to exert an essentially upward force on the strut which results in an initial outward force applied to the door. This structure, however, creates an upward deflection of the strut which must be overcome by the cable in opening the door. Further, this repeated deflection could result in structural damage to the strut.

Those concerned with the above problems recognize a need for a canopy door having an improved stabilizing means and an improved initial opening mechanism.

SUMMARY OF THE INVENTION

The canopy door of this invention includes an extensible diagonal strut having an intermediate pivot point which is disposed below the line extending between the pivotal connections of the ends of the strut when the door is in a closed position. An operating cable is attached to the strut to elevate the intermediate pivot point from its over-center position and thereby exert an initial outward force on the door.

When in the closed position, the door is stabilized against inward or outward movement by the strut. Inward movement is prevented since the strut is mechanically locked against retraction, and outward movement is prevented by a spring and attached closing cable which are substantially aligned with the strut to exert an inwardly directed force on the door.

An object of the present invention is the provision of an improved canopy type door.

Another object is to provide an improved strut which exerts an initial outward opening force to start the door to its open position.

A further object of the invention is the provision of a canopy door stabilized against wind gusts when in a closed position.

Still another object is to provide a canopy door which is easy to operate and maintain.

Other objects, advantages, and novel features of the present invention will become apparent from the following detailed description of the invention when considered in conjunction with the accompanying drawings.

BRIEF DESCRIPTION OF THE DRAWINGS

FIG. 8 is an isolated elevational view showing the lower leaf cable attached to the drum on the line shaft;

FIG. 9 is an isolated elevational view showing the upper leaf cable attached to the line shaft;

FIG. 10 is an isolated elevational view of the strut closing cable attached to the drum on the line shaft; and FIG. 11 is an isolated elevational view of the strut opening cable attached to the line shaft.

DESCRIPTION OF THE PREFERRED EMBODIMENTS

Figure 1:
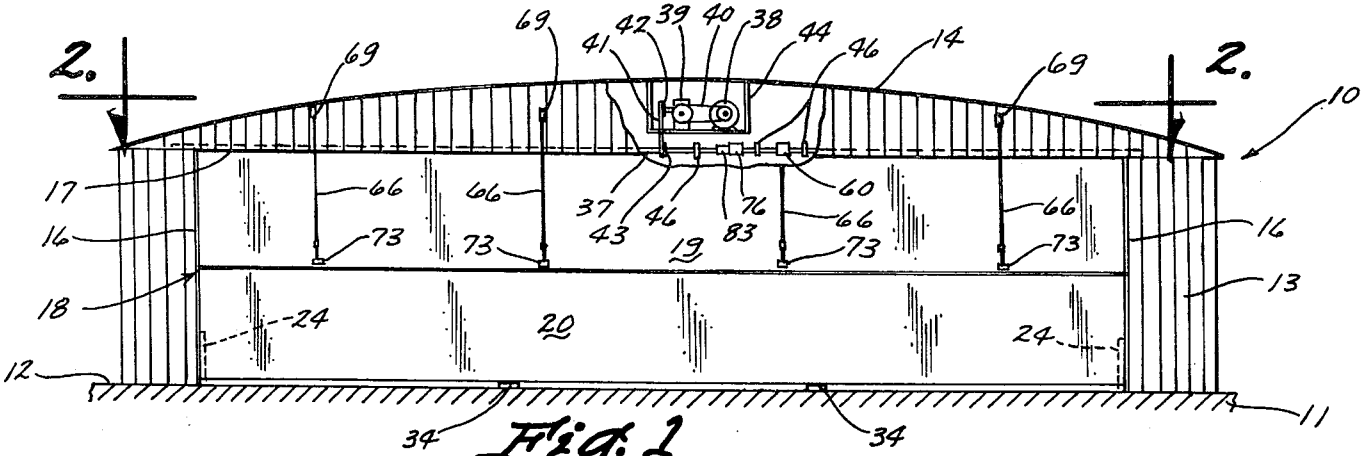
FIG. 1 is a front elevational view of a building equipped with the canopy door of the present invention having a portion cut away to show the drive and associated line shaft.

Referring now to the drawings, wherein like reference numerals designate identical or corresponding parts throughout the several views, FIG. 1 shows a typical building 10, such as a warehouse or hanger, using the canopy door of this invention. The building 10 includes a concrete base floor 11 having an upper flat surface 12. Vertical sidewalls 13 extend up from and are supported by the floor 11 and a curved roof 14 is disposed over sidewalls 13 to form a closed building 10. The building 10 includes a large opening defined by a door frame comprising side jambs 16 and a horizontal header 17.

Figures 4, 5, 6, 7:
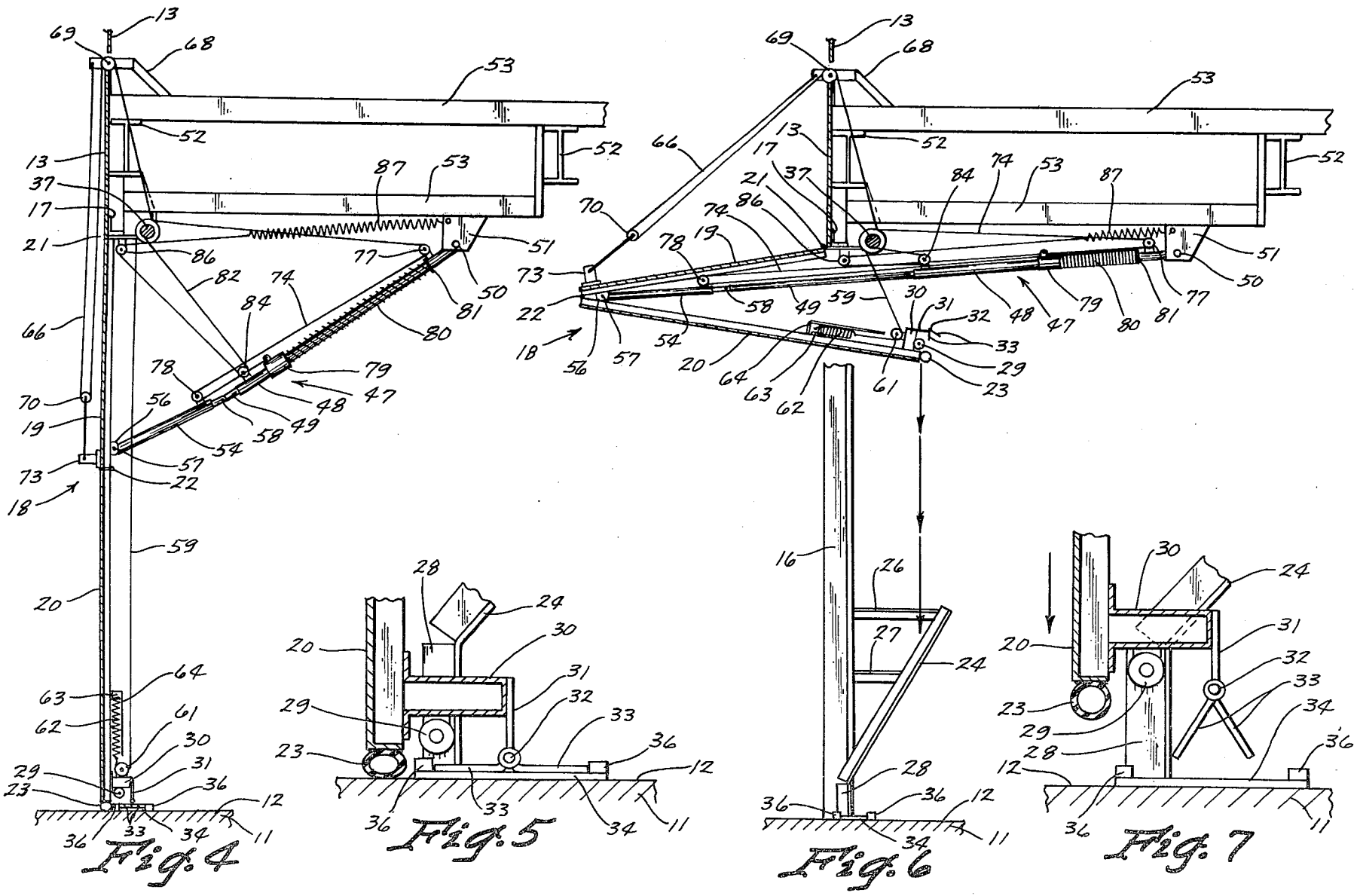
FIG. 4 is a side elevational view showing the canopy door in a closed position.
FIG. 5 is an enlarged sectional view of the lower portion of the door when in the closed position, showing the stabilizer member.
FIG. 6 is a view similar to FIG. 4 except the door is in an open position and one of the lower end guiding tracks is shown.
FIG. 7 is an enlarged sectional view similar to FIG. 5 except the door is slightly raised from the closed position.

The canopy type door is designated by reference numeral 18 and includes a first upper leaf 19 and a lower leaf 20. The upper leaf 19 is pivotally attached to the header 17 by a series of hinges 21, and is thereby adapted for swinging movement about a fixed horizontal axis. A second series of hinges 22 pivotally connect the inward side of the lower leaf 20 to the bottom edge of the upper leaf 19, thereby adapting the lower leaf 20 for swinging movement back under the upper leaf 19 as shown in FIG. 6. A weather strip 23 is mounted along the bottom edge of lower leaf 20 to form a seal with the floor surface 12 when the door 18 is in a closed position.

A pair of inclined tracks 24, one of which is shown in FIG. 6, are rigidly attached to jambs 16 at opposite sides of door 18. The track 24 is disposed inward of the jamb 16 and the upper portion of track 24 is supported by plates 26 and 27 which extend between the track 24 and jamb 16. The lower portion of track 24 includes a vertical section 28 which is attached, such as by welding, to the jamb 16. A pair of rollers 29 are rotatably mounted at the lateral edges of the lower leaf 20 on opposite sides thereof. The tracks 24 are positioned to engage rollers 29 and guide the lower edge of the lower leaf 20 into vertical alignment with the first leaf 19 as the door 18 approaches the closed position.

As most clearly shown in FIGS. 5 and 7, a reinforcing bracket 30 is attached to the lower portion of the lower leaf 20 and extends inwardly therefrom. A plurality of stabilizer members are attached to bracket 30 and are spaced across the width of door 18. The stabilizer members include a bar 31 rigidly attached to bracket 30 and extending downwardly therefrom. The lower end of bar 31 is formed to receive a pin 32. A pair of straps 33 are pivotally connected to pin 32. The straps 33 are restrained against movement in the direction of each other, as a conventional door hinge; thus the free ends of straps 33 are spaced apart when the straps 33 are hanging freely, as shown in FIG. 7.

A plurality of plates 34 having raised projections 36 are attached to base floor 11 and are disposed in mating relationship with straps 33 when the door 18 is in the fully closed position (FIG. 5). As the door 18 approaches the closed position the vertical section 28 of track 24 guides the lower leaf 20 in a substantially vertical downward path, as shown in FIG. 7. When the free ends of straps 33 contact the plate 34, the straps 33 progressively pivot about pin 32 until they reach the horizontal position shown in FIG. 5; at which point the door 18 is in the fully closed position. Abutment of the ends of straps 33 with the raised projections 36 stabilizes the lower edge of lower leaf 20 against inward or outward horizontal movement.

Figure 2:
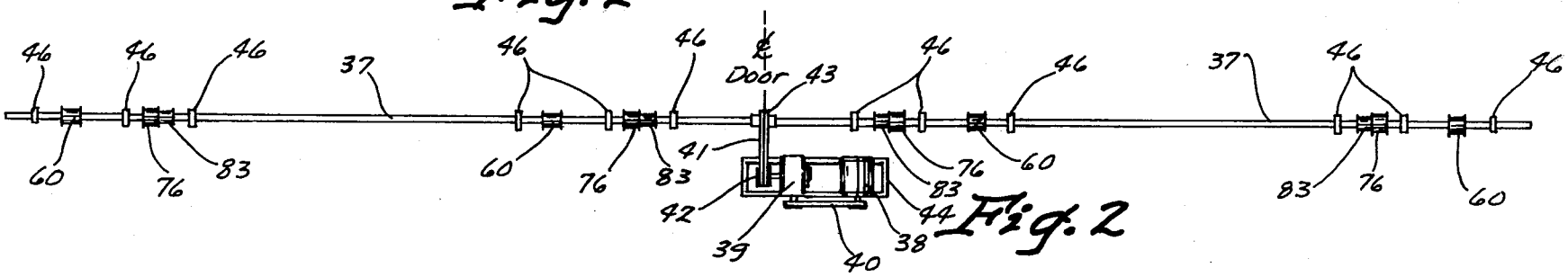
FIG. 2 is an isolated plan view showing the drive and associated line shaft.

The operating mechanism for opening and closing the door 18 includes a line shaft 37 which extends across the width of the door 18. As best shown in FIG. 2 the line shaft 37 is drivably rotated by a reversible electric motor 38. The motor 38 is mechanically coupled to the input side of the self-locking worm gear type speed reducer 39 via a belt 40, and the output or low speed side of speed reducer 39 is coupled to the line shaft 37 via a chain 41 and a pair of sprockets 42 and 43, the latter being mounted on line shaft 37. The motor 38 is activated by appropriately located conventional push bottom switches (not shown). Also, suitable limit switches (not shown) of conventional design are used to deactivate the motor 38 when the door 18 reaches its fully opened or fully closed positions.

The motor 38 and speed reducer 39 are supported by frame 44, and line shaft 37 is supported by a plurality of bearing brackets 46 which are rigidly attached to header 17. The line shaft 37 carries a number of drums for taking up and paying out the various cables as will be described hereinafter. FIG. 2 illustrates a line shaft 37 carrying four identical sets of drums, it being understood that the required number of such sets will be determined by the width of the door 18. For simplicity of description, only one set of drums and the associated cables, as shown in FIG. 3, will be described.

Although the entire door 18 could be made of a single section hingedly mounted at the top thereof, the drawings illustrate a door 18 which includes a first upper leaf 19 and a lower leaf 20 which are connected by hinges 22 as previously described. It is to be understood in the following description that all structure associated with the lower leaf 20 could be eliminated when considering a single-section door 18.

An extensible diagonal strut 47 is employed in conjunction with each set of drums and associated cables. Each strut 47 (FIGS. 4 and 6) includes a first member having an outer tube 48 and an inner rod 49 which is telescopically received therein. The upper end of tube 48 is pivotally connected by a pin 50 to fixed bracket 51 which depends from the interior framework of the building 10, including beams 52 and trusses 53. Each strut further includes a second member 54 which is pivotally connected at its lower end to first leaf 19 via bracket 56 and pin 57. The upper end of second member 54 and the lower end of rod 49 are pivotally connected by intermediate pivot pin 58. When the door 18 is in the closed position, as shown in FIG. 4, pin 58 lines below a line extending between pin 50 and pin 57 in an overcenter position, while rod 49 is locked against further retractions within tube 48.

Figure 3:
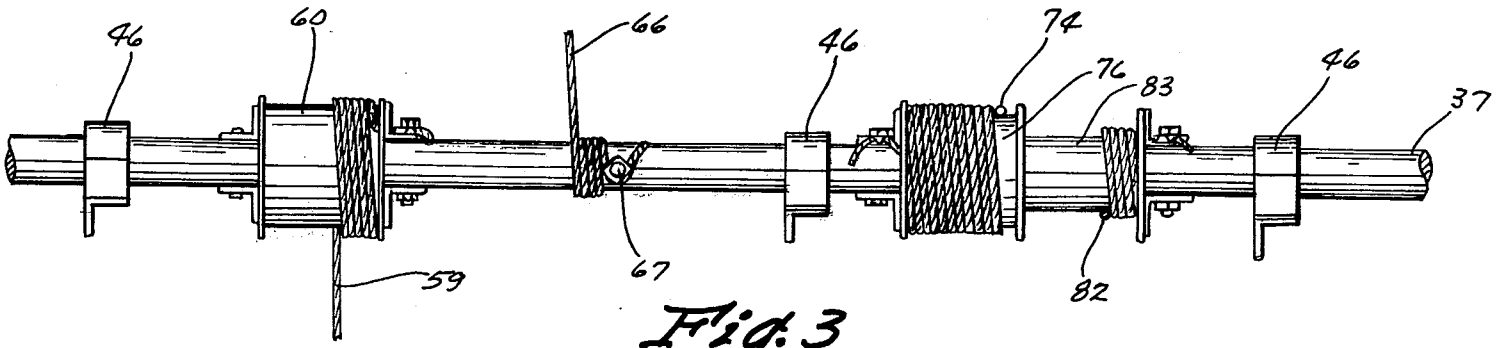
FIG. 3 is an enlarged view of a portion of FIG. 2 illustrating the cables controlled by the line shaft.

As clearly shown in FIG. 3, all of the cables in each set are attached to line shaft 37 either directly or via drums; and, therefore, the cables will be taken up or payed out simultaneously as the line shaft 37 rotates. To permit the cables to be taken up or payed out at the proper rate with respect to each other, drums of various diameters are used to compensate for the various required distances of travel of the cables.

Understanding that all of the cables will operate simultaneously, for simplicity, each cable will be described in isolation as illustrated in FIGS. 8–11. The four individual cables of FIGS. 8–11 comprise a single set of cables as shown in FIG. 3.

The lower leaf 20 is raised and lowered by the taking up and paying out of lower leaf cable 59. As shown in FIGS. 3 and 8, one end of cable 59 is attached to line shaft 37 via drum 60. Cable 59 extends downward from drum 60 and is trained around pulley 61 which is rotatably mounted on bracket 30. The other end of cable 59 is attached to spring 62 which in turn is attached to the lower leaf 20 via bracket 63. Spring 62 is enclosed in housing 64 which has a notched opening in the lower end to accomodate pulley 61. The cable 59 is kept in constant tension by spring 62.

The upper leaf 19 is raised and lowered by the operation of upper leaf cable 66 which interconnects the upper leaf 19 with line shaft 37, as shown in FIG. 9. One end of cable 66 is attached directly to line shaft 37, as by fastener 67 (FIG. 3). A support 68 is attached to truss 53 and a portion thereof extends through an opening in sidewall 13 (FIGS. 4 and 6). Pulley 69 is mounted on support 68 near the opening in sidewall 13, and cable 66 extends from the interior to the exterior of building 10, being trained around pulley 69. Cable 66 then extends downward to pulley 70, thence upward and is attached to support 68. Pulley 70 is held in clevis 71 which is attached by line 72 to outer bracket 73. Bracket 73 is attached to the lower portion of leaf 19 and extends outward to create a moment arm whereby taking up of cable 66 causes lower leaf 19 to swing outward and upward about its fixed horizontal axis.

As shown in FIGS. 3 and 10, one end of strut closing cable 74 is attached to line shaft 37 via drum 76; cable 74 then passes around pulley 77 attached to tube 48, around pulley 78 attached to second strut member 54, and the opposite end is attached to sliding spring retainer 79. Spring 80 surrounds a portion of tube 48 and one end is secured in sliding retainer 79 and the opposite end is attached to retainer 81 which is rigidly attached to tube 48 near its upper end.

FIGS. 3 and 11 illustrate one end of strut opening cable 82 attached to line shaft 37 via drum 83. From the drum 83 cable 82 then passes around pulley 84 attached to tube 48, around pulley 86 attached to header 17, and the opposite end is attached to one end of spring 87. The opposite end of spring 87 is attached to fixed bracket 51; and spring 87 thereby acts to maintain cable 82 in tension.

Having described the structure of the canopy door 18, the operation can now be readily understood. Assuming that the door 18 is in the fully closed position as shown in FIG. 4, the motor 38 is activated via a switch (not shown) so that the line shaft 37 is rotated in a clockwise direction as viewed in FIGS. 8–11. Since springs 62 and 87 are extended, this results in the taking up of cables 59, 66 and 82. As strut opening cable 82 is taken up the intermediate pivot pin 58 is elevated, since the rod 49 is locked against further retraction into tube 48. As the pin 58 is moved upward from its overcenter position, the strut 47 exerts an initial outward opening force at the point of pin 57 and causes the door 18 to "break" or open at hinges 22. Simultaneously, cables 59 and 66 exert an upward force on lower leaf 20 and upper leaf 19 and the door 18 progressively opens to the fully open position shown in FIG. 6, at which point a limit switch (not shown) deactivates the motor 38.

As cables 59, 66 and 82 are being taken up, cable 74 is being payed out from drum 76. Since spring 81 is extended when door 18 is in the closed position, this paying out allows spring 81 to relax and allows the progressive extension of rod 49 from tube 48 as the door 18 moves between the fully closed and fully opened positions.

When it is desired to move the door 18 from the fully open position (FIG. 6) to the closed position (FIG. 4), the motor 38 is activated to rotate the line shaft 37 in a counterclockwise direction as viewed in FIGS. 8–11. This rotation results in the paying out of cables 59, 66 and 82 which permits the lower leaf 20, the upper leaf 19, and the strut 47 to progressively descend by gravity towards the fully closed position. As the lower end of lower leaf 20 descends the rollers 29 engage track 24 and the lower leaf 20 is thereby guided towards a vertical position. When the rollers 29 reach vertical section 28 (FIG. 7) the straps 33 are aligned with plates 34; and as the door 18 reaches the fully closed position (FIG. 5) the straps 33 pivot into mating relationship with plate 34 and projections 36 as previously described. When the fully closed position is reached, a limit switch (not shown) deactivates motor 38.

Simultaneously, with the paying out of cables 59, 66 and 82, strut closing cable 74 is taken up on drum 76. The tension of cable 74, together with the lowering of upper leaf 19, causes rod 49 to progressively retract into tube 48 and pilot the door 18 in closing. When the door 18 reaches the fully closed position (FIG. 4) gravity causes pin 58 to return to its over-center position; further, cable 74 attached to sliding spring retainer 79 causes spring 80 to extend and exert an inward force on upper leaf 19 at pin 57 thereby holding upper leaf 19 in the fully closed position.

Obviously many modifications and variations of the present invention are possible in light of the above teachings. It is therefore to be understood that, within the scope of the appended claims, the invention may be practiced otherwise than as specifically described.

We claim:

1. A canopy door comprising:

a first leaf including an upper portion pivotally mounted for swinging about a fixed horizontal axis, and a lower free edge adapted to be moved between a first elevated open position and a second lowered closed position;

means connected to said first leaf for raising and lowering the lower edge thereof, thereby causing said first leaf to pivot about said fixed horizontal axis;

an extensible diagonal strut including;

a first telescoping member pivotally connected at its upper end to a fixed point inward of the door, said first member being inclined downwardly and outwardly from said fixed point;

a second member pivotally connected at its lower end to a point on said first leaf, said second member being inclined upwardly and inwardly from said point;

an intermediate pivot defining an intermediate point of pivotal connection between said first member and said second member, said intermediate point being disposed to lie below a line extending between said fixed point and said point on said first leaf when said door is in said closed position;

means connected to said strut for elevating said intermediate point thereby exerting an initial outward opening force on said first leaf;

a lower leaf, including an upper portion pivotally mounted to the lower edge of said first leaf for swinging about a horizontal axis, and a lower edge adapted to be moved between a first elevated open position and a second lowered closed position;

means connected to said lower leaf for raising and lowering the lower edge thereof;

means for guiding the lower edge of said lower leaf into vertical alignment with said first leaf as the door approaches said closed position, wherein said guiding means includes a pair of rollers rotatably mounted at the lateral edges of said lower leaf on opposite sides thereof; and a pair of inclined tracks rigidly mounted inward of the door and adapted to engage said rollers as the door approaches said closed position.

2. The canopy door of claim 1 wherein said inclined tracks further include a vertical section attached to the lower end thereof.

3. A canopy door comprising:

a first leaf including an upper portion pivotally mounted for swinging about a fixed horizontal axis, and a lower free edge adapted to be moved between a first elevated open position and a second lowered closed position;

means connected to said first leaf for raising and lowering the lower edge thereof, thereby causing said first leaf to pivot about said fixed horizontal axis;

an extensible diagonal strut including;

a first telescoping member pivotally connected at its upper end to a fixed point inward of the door, said first member being inclined downwardly and outwardly from said fixed point;

a second member pivotally connected at its lower end to a point on said first leaf, said second member being inclined upwardly and inwardly from said point;

an intermediate pivot defining an intermediate point of pivotal connection between said first member and said second member, said intermediate point being disposed to lie below a line extending between said fixed point and said point on said first leaf when said door is in said closed position;

means connected to said strut for elevating said intermediate point thereby exerting an initial outward opening force on said first leaf;

a lower leaf, including an upper portion pivotally mounted to the lower edge of said first leaf for swinging about a horizontal axis, and a lower edge adapted to be moved between a first elevated open position and a second lowered closed position;

means connected to said lower leaf for raising and lowering the lower edge thereof;

means for stabilizing the lower edge of said lower leaf against horizontal movement when the door is in said closed position, wherein said stabilizing means includes:

a plurality of stabilizers mounted on said lower leaf and spaced along the lower edge thereof, each of said stabilizers including;

a pair of straps hingedly connected at the upper ends to said lower leaf, said straps being restrained against movement in the direction of each other and adapted for movement on a common horizontal axis away from each other; and a plurality of horizontal plates mounted on a base floor, said plates having raised projections at each end, said plates being disposed along the base floor and adapted to matingly engage said straps between said raised projections when said door reaches said closed position, whereby said lower leaf is stabilized against inward or outward horizontal movement.

* * * * *